United States Patent [19]

Holopainen et al.

[11] Patent Number: 5,041,213

[45] Date of Patent: Aug. 20, 1991

[54] PRESSURIZED SCREENING DEVICE

[75] Inventors: Pentti Holopainen; Jouko Hautala, both of Tampere, Finland

[73] Assignee: Oy Tampella Ab, Tampere, Finland

[21] Appl. No.: 533,433

[22] Filed: Jun. 5, 1990

[30] Foreign Application Priority Data

Jun. 5, 1989 [FI] Finland ..... 892735

[51] Int. Cl.[5] ..... B07B 1/20; D21D 5/16

[52] U.S. Cl. ..... 209/273; 209/306; 209/380

[58] Field of Search ..... 209/273, 250, 380, 306, 209/305; 210/413-415; 162/55

[56] References Cited

U.S. PATENT DOCUMENTS

| | | | |
|---|---|---|---|
| 817,333 | 4/1906 | Orrman | 209/273 |
| 868,341 | 10/1907 | Holden | 209/273 |
| 1,742,592 | 1/1930 | Haug | 209/273 |
| 2,246,669 | 6/1941 | Cowan | 209/273 |
| 3,637,077 | 1/1972 | Cowan | 209/273 |
| 4,749,475 | 6/1988 | Hooper | 209/273 |

FOREIGN PATENT DOCUMENTS

| | | | |
|---|---|---|---|
| 0025310 | 8/1980 | European Pat. Off. . | |
| 34534 | 3/1913 | Fed. Rep. of Germany | 209/273 |
| 35151 | 7/1965 | Finland . | |
| 53493 | 2/1920 | Sweden | 209/306 |

*Primary Examiner*—Donald T. Hajec

*Attorney, Agent, or Firm*—Pollock, Vande Sande & Priddy

[57] ABSTRACT

The pressurized screening device designed for screening fiber pulps, especially paper pulp is provided with a screenplate with perforations, cleaning members being in connection with and moving relative to the screenplate, devices for generating the relative motion between the screenplate and the cleaning members, piping firstly for introducing fiber pulp into the pressurized screening device, secondly for conducting the accepted fiber pulp into the next process stage and thirdly for discharging rejected pulp from the pressurized screening device preferably to be returned into the pressurized screening device, and guiding devices for shifting the flow direction of unscreened fiber pulp to a direction substantially perpendicular to the screenplate. The guiding devices include a combination of several compartments for guiding the flow of fiber pulp which are comprised of side walls, a back wall and baffle blades.

11 Claims, 2 Drawing Sheets

PRESSURIZED SCREENING DEVICE

FIELD OF THE INVENTION

The invention relates to a pressurized screening device for screening fibre pulp, especially paper pulp or corresponding, the pressurized screening device having a screenplate with perforations, at least one means, which is in connection with and moves relative to the screenplate, for maintaining the screenplate clean and the perforations open during screening, means for generating the relative motion between the screenplate and the at least one means for maintaining the screenplate clean and the perforations open during screening, piping means firstly for introducing fibre pulp into the pressurized screening device, secondly for conducting the accepted fibre pulp into the next process stage and thirdly for discharging the rejected pulp from the pressurized screening device preferably to be returned into the pressurized screening device, and guiding devices for turning the flow direction of the fibre pulp to be screened entering the pressurized screening device essentially parallel with the screenplate to a direction essentially perpendicular to the screenplate.

BACKGROUND OF THE INVENTION

The essential parts of the construction described above are known from Finnish patent FI-2820. The construction in question is, however, a so-called centrifugal screener. The object of this construction is to introduce pulp to a rotor having uniformly bent blades, the rotor accelerating the pulp into a rotary motion in a manner necessary in centrifugal screeners. Accelerating of pulp into a rotary motion requires much energy. Furthermore, rotating pulp passes the perforations in the screenplate with high velocity and, therefore, the pulp fibre velocity parallel with the screenplate must abruptly slow down and turn perpendicular to the screenplate in order to pass through the perforations of the screenplate.

SUMMARY OF THE INVENTION

The object of the present invention is to upgrade the state of art in the field, specifically the important screening stage, and thus gain several benefits in processes which utilize screening. The pressurized screening device according to the present invention is meant to be placed at such a process stage where fibre pulp is processed the last time before entering the actual manufacturing process. Especially in the case of paper mills this means that the pressurized screening device according to the invention is placed as the last screen in the short cycle of the paper mill. The pressurized screening device functions immediately before the head box as the last screening stage, the incoming pulp having already been screened at least once at an earlier process stage. Therefore, there is no need to impose any high demands for the separating capacity but instead one strives to maximise the flow per unit area.

In order to attain the objects described above and to remove the drawbacks in the present technique the pressurized screening device according to the invention is mainly characterized in that the guiding devices for turning the fibre pulp essentially perpendicular to the screenplate comprise an assembly having two or more compartments for guiding the flow of fibre pulp, the compartments comprising:

in lateral direction, essentially closed side walls, which are essentially parallel with the incoming flow of the pulp, a back wall connecting those edges of the side walls which lie farmost from the screenplate and at least two baffle blades disposed between the side walls and arranged in succession in the flow direction of fibre pulp and directed towards the screenplate, which baffle blades are designed to divide and turn the flow of the paper pulp essentially entering each compartment in a direction essentially parallel with the screenplate to a flow essentially perpendicular to the screenplate at each portion of the screenplate adjacent the compartment in question.

Dividing the guide elements into compartments in the above manner, the flow of fibre pulp can be guided directly to the screenplate and the velocity of fibre flow can be smoothly changed from a velocity parallel with the screenplate to a velocity perpendicular to the screenplate. The means for maintaining the screen plates clean and the perforations open, preferably positioned between the screenplate and the compartments, can constructed in such a way and can be positioned in the pressurized screening device so that its motion relative to the screenplate cannot generate any essential velocity component parallel with the screenplate to the pulp before fibre pulp enters the compartments on one hand and from the compartments to the perforations of the screenplate on the other hand. From a constructional viewpoint, the means for maintaining the screenplate clean and the perforations open during screening has been expressly and exclusively designed for this purpose.

Following description will further illustrate the pressurized screening device according to the invention by reference to the enclosed drawings. In the drawings

DETAILED DESCRIPTION OF THE PREFERRED EMBODIMENT(S)

Figure 1:
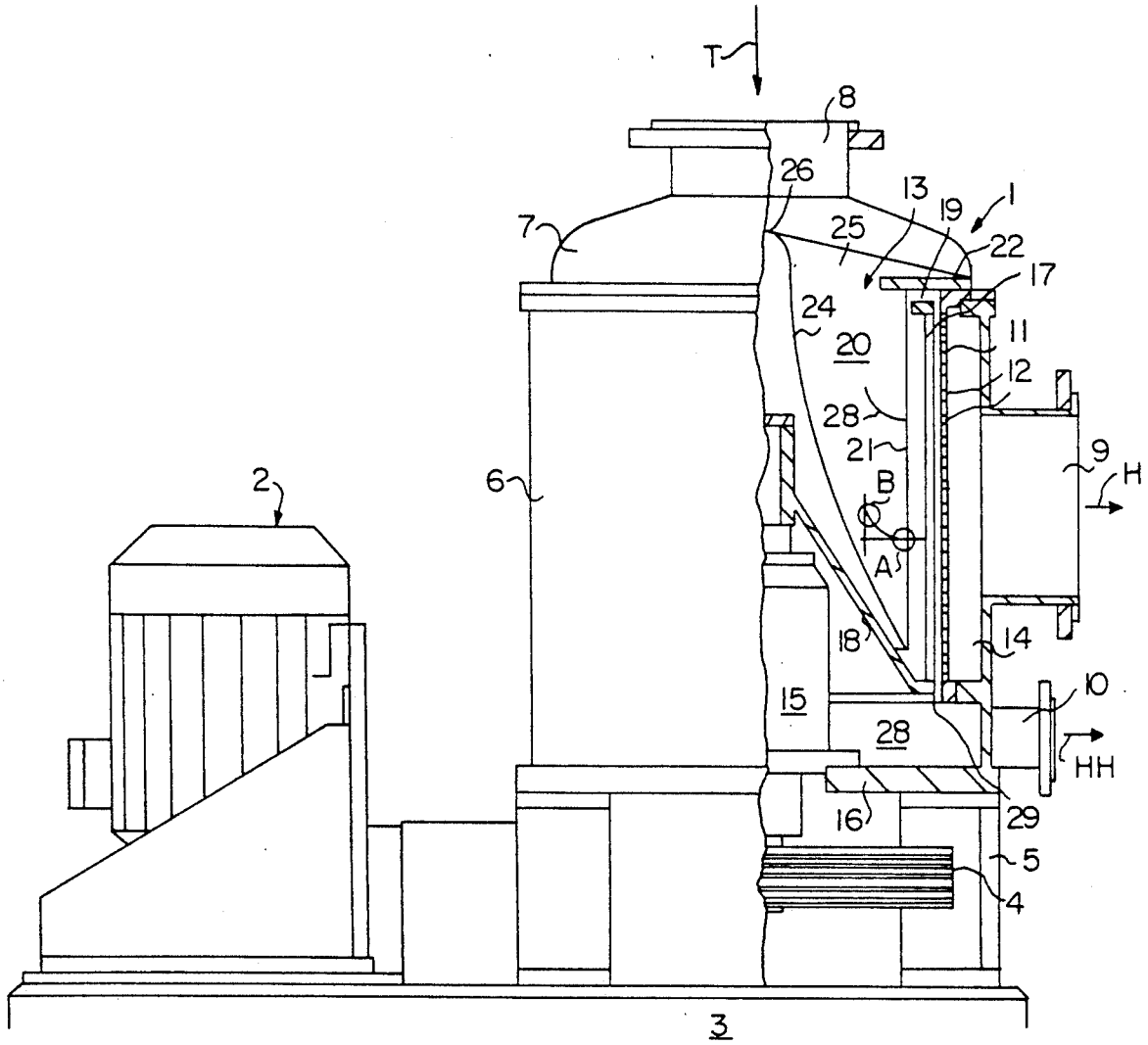
FIG. 1 shows a partially cross-sectional side view of one embodiment of the pressurized screening device according to the present invention.

With special reference to FIG. 1 the pressurized screening device 1 according to the invention and the drive mechanism has been mounted on a rigid bed 3. For instance, an electric motor is used as the driving mechanism 2 driving the moving parts of the pressurized screening device, for instance, via a belt transmission 4.

The actual pressurized screening device 1 consists of a stand 5, having belt transmission 4 inside, a housing 6 on top having preferably a circular cross-section and a vertical center line. Attached to the top of housing 6 there is an end part 7 having a pipe 8 functioning as the inlet opening for supplying fibre pulp into the pressurized screening device ( arrow T) essentially parallel with the center line of housing 6. Housing 6 accomodates also a pipe 9 for conducting the accepted pulp to the next process stage ( arrow H) and also a pipe 10 for removing the rejected pulp from the pressurized screening device ( arrow HH), and then, in most cases, it is beneficial to return it via washing stages back into the pressurized screening device through pipe 8. Housing 6 of pressurized screening device 1 accommodates a perforated screen plate 11 having a cylindrical surface with open ends and being so positioned that the center line is coincident or parallel with the center line of housing 6. Screenplate 11 comprises perforations 12 through which the accepted portion of the pulp goes from the guiding devices 13 to an annular space 14 being radially bounded by housing 6 and having connection with the pipe 9. Screenplate 11 is rigidly connected to the pressurized screening device 1.

Belt transmission 4 is linked to a vertical unit 15 supporting on the lower horizontal end 16 of housing 6 and comprising a bearing unit. A conical body 18 of the means 17 for maintaining the screenplate clean and the perforations open, later called as cleaning means, is attached to the upper end of unit 15, the actual cleaning means 17 being disposed on the lower edge thereof and being designed to move along the inner surface of screenplate 11. The cleaning means 17 move within an annular vertical space 19 bounded by the front edge 21 of the side walls 20 of the guiding device 13 on one hand and by the inner surface of screenplate 11 on the other hand. Cleaning means 17 rotate along the cylindrical inner surface of the screenplate driven by unit 15 of the driving mechanism 2.

Figure 2:
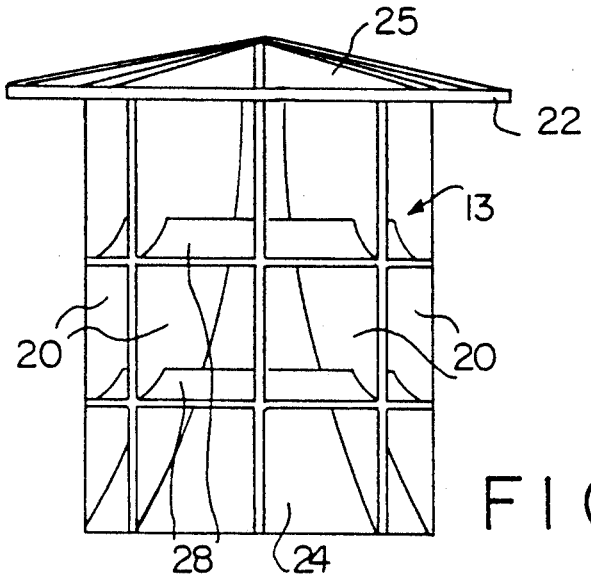
FIG. 2 shows a side view of one embodiment of the guiding device.
Figure 3:
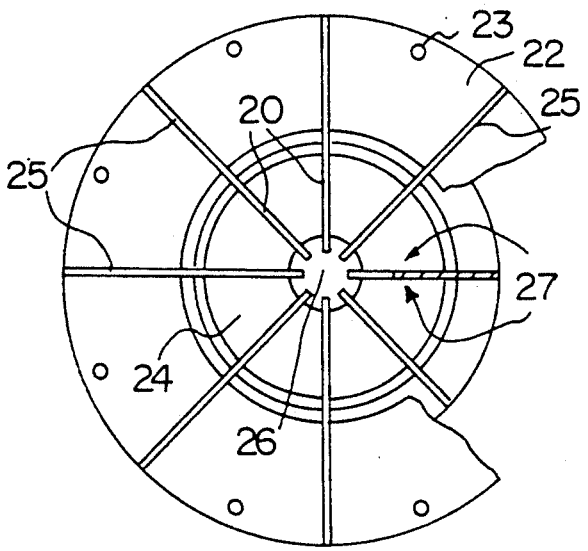
FIG. 3 shows a partially cross-sectional view of one embodiment of the guiding device according to FIG. 2 seen from above.

FIGS. 2 and 3 show more particularly embodiment of guiding devices 13. As seen from FIG. 1, guiding devices 13 are rigidly supported relative to the pressurized screening device 1 by an annular horizontal flange 22 on the upper edge of housing 6. The horizontal flange 22 is provided with holes 23 for bolt joint. The horizontal flange 22 is supported by triangular bars 25 on a conical surface 24 formed by the back walls of the guiding devices 13. The bars have been arranged to extend radially from the upper part of the cone 24 forming the back wall and being closed in its upper part 26. Side walls 20, which are preferably of one piece, are formed under bars 25 forming together with bars 25 several circumferentially adjacent compartments 27 whose longitudinal direction is primarily parallel with the flow direction (arrow T) of the pulp entering the pressurized screening device. Turning of this flow takes place in compartments 27 into a flow essentially perpendicular to screenplate 11 of the pressurized screening device at each compartment. Therefore, at least two baffle blades 28 have been disposed, arranged in succession in the vertical direction of the guiding device 13, between the side walls 20, the baffle blades being in the longitudinal cross-section curved so that their concave surface is essentially directed upwards, towards the incoming flow, whereupon in the vertical cross-section the tangent of the trailing edge of baffle blade 28 at the side edge 21 of side walls 20 is perpendicular to the screenplate (point A in FIG. 1). The edge of each blade 28, the entrance edge, which lies farmost from the front edge 21 of side walls 20, is loose from the conical surface 24 forming the back wall, and the tangent in the vertical cross-section of the baffle blade is essentially parallel with the flow of the entering fibre pulp ( point B in FIG. 1). The tangent can be common to baffle blades 28 whereupon the entrance edges lie in the same vertical line in a given vertical cross-section. In this case, the pulp flowing forwards in compartment 27 and passing the baffle blade goes from between the edge and the back wall.

The conical surface forming the back wall extends downwards and therefore in a horizontal cross-section, downwardly narrowing compartments 27 are formed. The conical surface 24 forms the last baffle blade. The rejected pulp goes into a space 28, which is in connection with the piping means 10, from the lower edge of screenplate 11 through an annular slot 29 between body 18 of cleaning device 17 and screenplate 11. Unit 15 and body 18 of cleaning device 17 are preferably placed inside the conical surface 24.

What is claimed is:

1. Pressurized screening device for screening fiber pulp, the pressurized screening device having a screenplate with perforations, at least one means, which is in connection with and moves relative to the screenplate, for maintaining the screenplate clean and the perforations open during screening, means for generating the relative motion between the screenplate and said at least one means for maintaining the screenplate clean and the perforations open during screening, piping means firstly for introducing fiber pulp into the pressurized screening device, secondly for conducting the accepted fiber pulp into the next process stage and thirdly for discharging the rejected pulp from the pressurized screening device to be returned into the pressurized screening device, and guiding devices for turning the flow direction of the fiber pulp to be screened entering the pressurized screening device substantially parallel with the screenplate to a direction substantially perpendicular to the screenplate wherein the guiding devices for turning the fiber pulp comprise an assembly having at least two compartments for guiding the flow of fiber pulp, the compartments comprising:

substantially closed side walls, which are substantially parallel with the incoming flow of pulp, a back wall connecting edges of the side walls which lie farmost from the screenplate, and at least two baffle blades disposed between the side walls and arranged in succession in the flow direction of the fiber pulp and directed towards the screenplate, which baffle blades are designed to divide and turn the flow of the paper pulp substantially entering each compartment in a direction substantially parallel with the screenplate to a flow substantially perpendicular to the screenplate at each portion of the screenplate adjacent the respective compartment.

2. Pressurized screening device according to claim 1, the screenplate being substantially cylindrical and placed inside a substantially cylindrical housing, the screenplate being rigidly connected to the pressurized screening device, and at least one means, which is movable relative to the pressurized screening device by the means for maintaining the screenplate clean and the perforations open during screening wherein the guiding devices are concentrically disposed relative to the center line of the screenplate and wherein the compartments have been designed to to extend radially from the surface formed by the back wall towards the screenplate.

3. Pressurized screening device according to claim 1, wherein the back wall includes, at least partially, a conical surface, wherein the conical shape enlarges in the feed direction of fiber pulp.

4. Pressurized screening device according to claim 1, wherein the farmost edge of a cone from the inlet of fiber pulp forms the last baffle blade.

5. Pressurized screening device according to claim 1, wherein the upper parts of the side walls are formed of radially protruding bars having a horizontal flange attached thereto, the flange being in turn attached to a jacket of the pressurized screening device.

6. Pressurized screening device according to claim 1, wherein the baffle blades are disposed so that they are disengaged from the back wall.

7. Pressurized screening device according to claim 1, wherein the baffle blades have, in the longitudinal cross-section of the compartment, a curved concave surface being directed towards the flow direction of the fiber pulp entering the pressurized screening device, whereupon the tangent drawn, in the longitudinal cross-section of the compartment, through an edge, being in connection with the edge of the side wall, of said baffle blades is substantially perpendicular to the screenplate and whereupon the tangent of the edge, being disengaged from the back wall, of the baffle blade, in the corresponding cross-section, is substantially parallel with the inlet stream of the fiber pulp.

8. Pressurized screening device according to claim 1, wherein the means for maintaining the screenplate clean and the perforations open have been attached to the lower edge of a substantially cone-shaped body, and wherein said body is rotatable around a vertical axis and then placed substantially inside the conical surface formed by the back wall.

9. Pressurized screening device according to claim 3, wherein the farmost edge of a cone from the inlet of the fiber pulp forms the last baffle blade.

10. Pressurized screening device according to claim 6, wherein the baffle blades have, in the longitudinal cross-section of the compartment, a curved concave surface being directed towards the flow direction of the fiber pulp entering the pressurized screening device, whereupon the tangent drawn, in the longitudinal cross-section of the compartment, through an edge, being in connection with the edge of the side wall, of said baffle blades is substantially perpendicular to the screenplate and whereupon the tangent of the edge, being disengaged from the back wall, of the baffle blade, in the corresponding cross-section, is substantially parallel with the inlet stream of the fiber pulp.

11. Pressurized screening device according to claim 3, wherein the means for maintaining the screenplate clean and the perforations open is attached to a substantially cone-shaped body, to the lower edge of the body, and wherein said body is rotatable around a vertical axis and then placed substantially inside the conical surface formed by the back wall.

* * * * *